US010472707B2

(12) United States Patent
Benedictus et al.

(10) Patent No.: US 10,472,707 B2
(45) Date of Patent: Nov. 12, 2019

(54) AL—ZN—MG—CU ALLOY WITH IMPROVED DAMAGE TOLERANCE-STRENGTH COMBINATION PROPERTIES

(71) Applicant: ALERIS ROLLED PRODUCTS GERMANY GMBH, Koblenz (DE)

(72) Inventors: Rinze Benedictus, Delft (NL); Christian Joachim Keidel, Montabaur (DE); Alfred Ludwig Heinz, Niederahr (DE); Nedia Telioui, Rotterdam (NL)

(73) Assignee: ALERIS ROLLED PRODUCTS GERMANY GMBH, Koblenz (DE)

( * ) Notice: Subject to any disclaimer, the term of this patent is extended or adjusted under 35 U.S.C. 154(b) by 345 days.

(21) Appl. No.: 14/141,960

(22) Filed: Dec. 27, 2013

(65) Prior Publication Data

US 2014/0224386 A1 Aug. 14, 2014

Related U.S. Application Data

(60) Division of application No. 12/497,987, filed on Jul. 6, 2009, now abandoned, which is a continuation of (Continued)

(30) Foreign Application Priority Data

Apr. 10, 2003 (EP) ..... 03076048

(51) Int. Cl.
*C22F 1/053* (2006.01)
*C22C 21/10* (2006.01)

(52) U.S. Cl.
CPC ..... *C22F 1/053* (2013.01); *C22C 21/10* (2013.01); *Y10T 428/12* (2015.01); *Y10T 428/12389* (2015.01)

(58) Field of Classification Search
CPC ..... C22F 1/053
See application file for complete search history.

(56) References Cited

U.S. PATENT DOCUMENTS 2,249,349 A 7/1941 Deutsch
3,287,185 A 11/1966 Vachet et al.
(Continued)

FOREIGN PATENT DOCUMENTS

DE 68927149 T 4/1997
DE 102004010700 10/2004
(Continued)

OTHER PUBLICATIONS

Requirement for Restriction / Election mailed in U.S. Appl. No. 10/821,184 dated Apr. 3, 2007, 5 pages.
(Continued)

*Primary Examiner* — George Wyszomierski
*Assistant Examiner* — Janell C Morillo
(74) *Attorney, Agent, or Firm* — Vorys, Sater, Seymour and Pease LLP

(57) ABSTRACT

An Al—Zn—Mg—Cu alloy with improved damage tolerance-strength combination properties. The present invention relates to an aluminum alloy product comprising or consisting essentially of, in weight %, about 6.5 to 9.5 zinc (Zn), about 1.2 to 2.2% magnesium (Mg), about 1.0 to 1.9% copper (Cu), preferable (0.9 Mg−0.6)≤Cu≤(0.9 Mg+0.05), about 0 to 0.5% zirconium (Zr), about 0 to 0.7% scandium (Sc), about 0 to 0.4% chromium (Cr), about 0 to 0.3% hafnium (Hf), about 0 to 0.4% titanium (Ti), about 0 to 0.8% manganese (Mn), the balance being aluminum (Al) and other incidental elements. The invention relates also to a method of manufacturing such as alloy.

32 Claims, 2 Drawing Sheets

Related U.S. Application Data application No. 10/821,184, filed on Apr. 9, 2004, now Pat. No. 7,666,267.

(60) Provisional application No. 60/469,829, filed on May 13, 2003.

(56) References Cited

U.S. PATENT DOCUMENTS 3,305,410 A 2/1967 Sublett et al.
3,418,090 A 12/1968 Fritzlen
3,674,448 A 7/1972 Brown
3,791,876 A 2/1974 Kroger
3,791,880 A 2/1974 Hunsicker et al.
3,794,531 A 2/1974 Markworth et al.
3,826,688 A 7/1974 Levy
3,857,973 A 12/1974 McKee et al.
3,881,966 A * 5/1975 Staley ..... C22F 1/053 148/417
3,984,259 A 10/1976 Rogers
4,140,549 A 2/1979 Chia et al.
4,189,334 A 2/1980 Dubost
4,196,021 A 4/1980 Bouvaist
4,305,763 A 12/1981 Quist et al.
4,462,843 A 7/1984 Baba
4,462,893 A 7/1984 Moriya et al.
4,477,292 A 10/1984 Brown
4,589,932 A 5/1986 Park
4,618,382 A 10/1986 Miyagi et al.
4,659,393 A 4/1987 Bouvaist
4,711,762 A 12/1987 Vernam et al.
4,713,216 A 12/1987 Higashi et al.
4,828,631 A 5/1989 Ponchel et al.
4,927,470 A 5/1990 Cho
4,946,517 A 8/1990 Cho
4,954,188 A 9/1990 Ponchel et al.
4,976,790 A 12/1990 McAuliffe et al.
4,988,394 A 1/1991 Cho
5,108,520 A 4/1992 Liu et al.
5,186,235 A 2/1993 Ward, Jr.
5,213,639 A 5/1993 Colvin et al.
5,221,377 A 6/1993 Hunt, Jr. et al.
5,277,719 A 1/1994 Kuhlman et al.
5,312,498 A 5/1994 Anderson
5,313,639 A 5/1994 Chao
5,356,495 A 10/1994 Wyatt-Mair et al.
5,496,423 A 3/1996 Wyatt-Mair et al.
5,496,426 A 3/1996 Murtha
5,560,789 A 10/1996 Sainfort et al.
5,593,516 A 1/1997 Cassada, III
5,624,632 A 4/1997 Baumann
5,681,405 A 10/1997 Newton et al.
5,718,780 A 2/1998 Bryant et al.
5,738,735 A 4/1998 Bechet
5,833,775 A 11/1998 Newton et al.
5,858,134 A 1/1999 Bechet et al.
5,865,911 A 2/1999 Miyasato et al.
5,865,914 A 2/1999 Karabin et al.
5,888,320 A 3/1999 Dorward
5,938,867 A 8/1999 Dorward et al.
6,027,582 A * 2/2000 Shahani ..... C22C 21/10 148/417
6,048,415 A 4/2000 Nakai et al.
6,120,623 A 9/2000 Gupta et al.
6,129,792 A 10/2000 Murtha
6,224,992 B1 5/2001 Delbeke et al.
6,238,495 B1 5/2001 Haszler et al.
6,315,842 B1 11/2001 Shahani et al.
6,337,147 B1 1/2002 Haszler et al.
6,444,058 B1 9/2002 Liu et al.
6,543,122 B1 4/2003 Perkins et al.
6,562,154 B1 5/2003 Rioja et al.
6,569,542 B2 5/2003 Warner et al.
6,602,361 B2 8/2003 Warner et al.
6,627,330 B1 9/2003 Shimizu et al.
6,652,678 B1 11/2003 Marshall et al.
6,726,878 B1 4/2004 Flidlyander et al.
6,743,308 B2 6/2004 Tanaka et al.
6,790,407 B2 9/2004 Fridlyander
6,972,110 B2 12/2005 Chakrabarti et al.
6,994,760 B2 2/2006 Benedictus et al.
7,060,139 B2 6/2006 Senkov et al.
7,097,719 B2 8/2006 Bray et al.
7,250,223 B2 7/2007 Miyachi et al.
7,294,213 B2 11/2007 Warner et al.
2001/0006082 A1 7/2001 Warner et al.
2001/0039982 A1* 11/2001 Sigli ..... C22C 21/10 148/550
2002/0011289 A1 1/2002 Warner
2002/0014288 A1 2/2002 Warner et al.
2002/0014290 A1 2/2002 Dif et al.
2002/0039664 A1 4/2002 Magnusen et al.
2002/0043311 A1 4/2002 Selepack et al.
2002/0121319 A1 9/2002 Chakrabarti et al.
2002/0150498 A1 10/2002 Chakrabarti et al.
2002/0153072 A1 10/2002 Tanaka et al.
2002/0162609 A1 11/2002 Warner et al.
2003/0140990 A1 7/2003 Ribes
2003/0219353 A1 11/2003 Warner et al.
2004/0007295 A1 1/2004 Lorentzen et al.
2004/0062946 A1 4/2004 Benedictus et al.
2004/0101434 A1 5/2004 Fridlyander et al.
2004/0109787 A1 6/2004 Haszler et al.
2004/0211498 A1 10/2004 Keidel et al.
2005/0006010 A1 1/2005 Benedictus et al.
2005/0034794 A1 2/2005 Benedictus et al.
2005/0067066 A1 3/2005 Tanaka et al.
2005/0072497 A1 4/2005 Eberl et al.
2005/0081965 A1 4/2005 Benedictus
2005/0095447 A1 5/2005 Baumann
2005/0189044 A1 9/2005 Benedictus et al.
2006/0016523 A1 1/2006 Dif
2006/0032560 A1 2/2006 Benedictus et al.
2006/0083654 A1 4/2006 Chakrabarti et al.
2006/0174980 A1 8/2006 Benedictus et al.
2006/0182650 A1 8/2006 Eberl
2007/0000583 A1 1/2007 Rioja et al.
2007/0151636 A1 7/2007 Buerger
2007/0204937 A1 9/2007 Buerger et al.
2008/0173377 A1 7/2008 Khosla
2008/0173378 A1 7/2008 Khosla
2008/0210349 A1 9/2008 Khosla
2009/0320969 A1 12/2009 Benedictus et al.
2010/0183474 A1 7/2010 Lin et al.
2017/0088920 A1 3/2017 Boselli et al.

FOREIGN PATENT DOCUMENTS

DE 10392805 6/2005
EP 0081441 6/1983
EP 0368005 A1 5/1990
EP 0377779 A1 7/1990
EP 0 462 055 A1 12/1991
EP 0587274 A1 3/1994
EP 0605947 A1 7/1994
EP 0670377 9/1995
EP 0799900 A1 10/1997
EP 0829552 A 3/1998
EP 0876514 11/1998
EP 0989195 3/2000
EP 1026270 A1 8/2000
EP 1045043 10/2000
EP 1143027 A1 10/2001
EP 1158068 11/2001
EP 1170394 A2 1/2002
EP 1231290 A1 8/2002
EP 1306455 A1 5/2003
EP 1382698 A1 1/2004
EP 1114877 A1 7/2004
FR 1508123 1/1968
FR 2066696 8/1971
FR 2163281 A5 7/1973
FR 2234375 1/1975
FR 2409319 6/1979

(56) References Cited

FOREIGN PATENT DOCUMENTS

| | | | |
|---|---|---|---|
| FR | 2472618 | | 7/1981 |
| FR | 2716896 | | 9/1995 |
| FR | 2841263 | | 12/2003 |
| FR | 2846669 | | 5/2004 |
| FR | 2855834 | | 12/2004 |
| GB | 0925956 | A | 5/1963 |
| GB | 1029486 | | 5/1966 |
| GB | 1231090 | | 5/1971 |
| GB | 1273261 | | 5/1972 |
| GB | 1427657 | | 3/1976 |
| GB | 2065516 | | 7/1981 |
| GB | 2114601 | A | 8/1983 |
| GB | 1603690 | | 11/2001 |
| GB | 2430937 | | 4/2007 |
| JP | 59126762 | | 7/1984 |
| JP | 61049796 | A | 3/1986 |
| JP | 62010246 | | 1/1987 |
| JP | 62122744 | A | 6/1987 |
| JP | 62122745 | A | 6/1987 |
| JP | 63319143 | A | 12/1988 |
| JP | 1039340 | A | 2/1989 |
| JP | 1208438 | A | 8/1989 |
| JP | 2047244 | A | 2/1990 |
| JP | 06128678 | | 5/1994 |
| JP | 6228691 | A | 8/1994 |
| JP | 8120385 | | 5/1996 |
| JP | 8144031 | | 6/1996 |
| JP | 09279284 | A | 10/1997 |
| JP | 10280081 | | 10/1998 |
| JP | 10298692 | | 11/1998 |
| JP | 2001020028 | | 1/2001 |
| JP | 2001115227 | | 4/2001 |
| JP | 2002/241882 | A | 8/2002 |
| JP | 2002241882 | A | 8/2002 |
| JP | 2003147498 | | 5/2003 |
| RU | 2044098 | C1 | 9/1995 |
| RU | 2165996 | C1 | 4/2001 |
| RU | 2184166 | C2 | 6/2002 |
| RU | 2215058 | C1 | 10/2003 |
| RU | 2215807 | C2 | 11/2003 |
| RU | 2003106552 | A | 10/2004 |
| SU | 664570 | | 5/1979 |
| SU | 1625043 | | 10/1995 |
| SU | 1625043 | A1 | 10/1995 |
| WO | 9203586 | | 3/1992 |
| WO | 9526420 | A1 | 10/1995 |
| WO | 96010099 | | 4/1996 |
| WO | 9628582 | | 9/1996 |
| WO | 9629440 | | 9/1996 |
| WO | 9722724 | A1 | 6/1997 |
| WO | 9837251 | A1 | 8/1998 |
| WO | 0054967 | A1 | 9/2000 |
| WO | 0210468 | A1 | 2/2002 |
| WO | 02052053 | A1 | 7/2002 |
| WO | 02075010 | A2 | 9/2002 |
| WO | 0376677 | A1 | 9/2003 |
| WO | 0385145 | A2 | 10/2003 |
| WO | 03085146 | | 10/2003 |
| WO | 2004001080 | A1 | 12/2003 |
| WO | 2004/090183 | A1 | 10/2004 |
| WO | 2004111282 | | 12/2004 |
| WO | 2005003398 | | 1/2005 |
| WO | 2016183030 | A1 | 11/2016 |

OTHER PUBLICATIONS

Advisory Action mailed in U.S. Appl. No. 10/976,154 dated Nov. 21, 2008, 4 pages.
Final Rejection mailed in U.S. Appl. No. 10/976,154 dated Oct. 15, 2009, 17 pages.
Final Rejection mailed in U.S. Appl. No. 10/976,154 dated May 29, 2008, 18 pages.
Non-Final Rejection mailed in U.S. Appl. No. 10/976,154 dated Feb. 18, 2009, 16 pages.
Non-Final Rejection mailed in U.S. Appl. No. 10/976,154 dated Sep. 20, 2007, 15 pages.
Advisory Action mailed in U.S. Appl. No. 11/239,651 dated Feb. 24, 2009, 3 pages.
Advisory Action mailed in U.S. Appl. No. 11/239,651 dated Mar. 23, 2010, 3 pages.
Final Rejection mailed in U.S. Appl. No. 11/239,651 dated Oct. 14, 2008, 10 pages.
Final Rejection mailed in U.S. Appl. No. 11/239,651 dated Dec. 7, 2009, 10 pages.
Non-Final Rejection mailed in U.S. Appl. No. 11/239,651 dated Feb. 22, 2008, 13 pages.
Non-Final Rejection mailed in U.S. Appl. No. 11/239,651 dated Jun. 1, 2009, 10 pages.
Non-Final Rejection mailed in U.S. Appl. No. 11/239,651 dated Jun. 8, 2010, 20 pages.
Advisory Action mailed in U.S. Appl. No. 11/773,904 dated Jun. 11, 2010, 3 pages.
Non-Final Rejection mailed in U.S. Appl. No. 11/773,904 dated Sep. 29, 2009, 19 pages.
Non-Final Rejection mailed in U.S. Appl. No. 11/773,904 dated Mar. 16, 2009, 18 pages.
Final Rejection mailed in U.S. Appl. No. 11/773,904 dated Mar. 4, 2010, 23 pages.
Advisory action dated Mar. 23, 2010 in U.S. Appl. No. 11/239,651.
Aluminium-Taschenbuch 15. Auflage, Dorossel et al., p. 20-25 (1999)(with partial translation).
Office action dated Jan. 28, 2010 for U.S. Appl. No. 12/547,466.
International Alloy Designations and Chemical Composition Limits for Wrought Aluminum and Wrought Aluminum Alloys (teal sheets), The Aluminum Association, miscellaneous annotated pages (Jul. 1998).
"Aluminum Viewed from Within", Altenpohl, 1st edition, pp. 118-131 (1982).
ASM Specialty Handbook, Aluminum and Aluminum Alloys, edited by J.R. Davis, ASM International, pp. 247-248 (1993).
Aluminum Properties and Physical Metallurgy, edited by J.E. Hatch, American Society for Metals, p. 112-113 (1984).
Oct. 15, 2009 Office Action for U.S. Appl. No. 10/976,154, Benedictus et al.
ASM Specialty Handbook Aluminum and Aluminum Alloys, J.R. Davis, ASM International Handbook Committee, pp. 290-295 and 319-320 copyright 1993.
Aluminum Properties and Physical Metallurgy, John E. Hatch, American Society for Metals, pp. 150-157 copyright 1984.
V.I. Dobatkin, Smelting and Casting of Aluminum Alloys, Moscow, "Metallurgy," 1970. p. 27.
Lakhtin, Yu. M. et al., Material Science, Moscow, "Machine Construction," 1980, p. 40.
"Heat Treating of Aluminum Alloys", ASM Handbook, vol. 4, pp. 841-856, 1995.
Russian Office action dated Jul. 1, 2008 from Russian patent application No. 2005134849/02(038965).
Office Action dated Sep. 20, 2007 of U.S. Appl. No. 10/976,154 to Benedictus et al.
Office Action dated May 29, 2008 of U.S. Appl. No. 10/976,154 to Benedictus et al.
Office Action dated Feb. 18, 2009 of U.S. Appl. No. 10/976,154 to Benedictus et al.
Office Action dated Feb. 22, 2008 of U.S. Appl. No. 11/239,651 to Benedictus et al.
Office Action dated Oct. 14, 2008 of U.S. Appl. No. 11/239,651 to Benedictus et al.
Office Action dated Jun. 1, 2009 of U.S. Appl. No. 11/239,651 to Benedictus et al.
Office Action dated Jun. 22, 2007 of U.S. Appl. No. 10/819,130 to Benedictus et al.
Office Action dated Jan. 25, 2008 of U.S. Appl. No. 10/819,130 to Benedictus et al.
Office Action dated Aug. 5, 2008 for U.S. Appl. No. 10/819,130 to Benedictus et al.
Office Action dated Feb. 26, 2009 for U.S. Appl. No. 10/819,130 to Benedictus et al.

(56) References Cited

OTHER PUBLICATIONS

The Russian State Standard GOST 4784-97, Aluminum and wrought aluminum alloys. Grades, Minsk, Publisher or Standards, 1999 p. 7, 8, table 6 (translation of table 6).
U.S. Appl. No. 11/773,900—Final Office Action dated Aug. 8, 2010.
U.S. Appl. No. 11/239,651—Notice of Allowance dated Sep. 24, 2010.
"Metal Products Distributor Supplier Engineering Metals and Materials Table of Contens", Engineers EDGE Solutions by Design, URL < http://www.engineersedge.com/aluminum_tempers.htm >; retrieved from the Internet Apr. 15, 2014.
Final Rejection dated Jan. 27, 2014 of U.S. Appl. No. 11/566,630 to Buerger et al.
"Superplastic forming" From Wikipedia, the free encyclopedia, URL < http://en.wikipedia.org/wiki/Superplastic_forming>; retrieved from the Internet Apr. 15, 2014.
May 21, 2013, Office Action for U.S. Appl. No. 11/773,919, Sunil Khosla et al. filed Jul. 5, 2007.
Non-final Office action dated Aug. 20, 2012, from U.S. Appl. No. 11/566,630 to Buerger, filed Dec. 4, 2006.
Non-final Office action dated Apr. 27, 2012, from U.S. Appl. No. 12/547,466 to Benedictus, filed Aug. 25, 2009.
Aluminum and Aluminum Alloys, ASM International, 1993, p. 23.
"Aluminum and Aluminum Alloys", ASM Internationl, 1993, p. 63.
Final Office Action dated Sep. 7, 2011 in U.S. Appl. No. 12/547,466.
Kuhlman, Forging of Aluminum Alloys-Forging Methods, vol. 14A, ASM Handbook, ASM International p. 1-6 (2005).
U.S. Appl. No. 11/773,919-Advisory Office Action dated Mar. 7, 2011.
U.S. Appl. No. 11/566,630-Final Office Action dated Apr. 5, 2011.
U.S. Appl. No. 12/547,466-Non-Final Office Action dated Mar. 31, 2011.
U.S. Appl. No. 11/773,919-Final Office action dated Nov. 18, 2010.
U.S. Appl. No. 11/566,630-Non-Final Office action dated Nov. 29, 2010.
U.S. Appl. No. 11/773,904-Non-Final Office action dated Dec. 22, 2010.
Airbus Industrie Material Specification AIMS 03-02-020 (Feb. 2002).
Hufnagel W: "Key to aluminum alloys, 4th edition" 1991, pp. 195-205, XP002194851.
Vojtech et al., "Improving the casting properties of high-strength aluminum alloys" Materiali in Technologiji 38, (2004), pp. 99-102.
P.T. Houldcroft, "A simple cracking test for use with argon-arc welding", British Welding Journal, Oct. 1955, pp. 471-475.
Pechiney Aluminium: "Demi produits aluminium; Characteristiques generales—Aluminium mill products; gereral properties;" Oct. 1985 (Oct. 1985) Announcement Pechiney Aluminium, pp. 1-5, XP002240985.
M.S. degree thesis of L.E. Oswald, titled "Effects of microstructure on high-cycle fatigue of an Al-Zn-Mg-Cu alloy (AI-7055)", pp. i-x and 1-54 (Apr. 2003).
Conversion table for hardness and tensile strength value DIN-EN ISO 18265-2003-11 (2003).
Arai et al. ASM Handbook, Heat Treating of Aluminum Alloys-Strengthening by Heat Treatment, ASM International, vol. 4, 1995, p. 5-7.
Advisory Action mailed in U.S. Appl. No. 11/773,919 dated Dec. 15, 2009, 3 pages.
Final Rejection mailed in U.S. Appl. No. 11/773,919 dated Sep. 25, 2009, 18 pages.
Non-Final Rejection mailed in U.S. Appl. No. 11/773,919 dated Mar. 16, 2009, 21 pages.
Non-Final Rejection mailed in U.S. Appl. No. 11/773,919 dated Jun. 8, 2010, 14 pages.
Advisory Action mailed in U.S. Appl. No. 11/773,900 dated Jan. 11, 2010, 3 pages.
Final Rejection mailed in U.S. Appl. No. 11/773,900 dated Sep. 24, 2009, 18 pages.
Non-Final Rejection mailed in U.S. Appl. No. 11/773,900 dated Mar. 17, 2009, 13 pages.
Non-Final Rejection mailed in U.S. Appl. No. 11/773,900 dated Mar. 4, 2010, 20 pages.
Advisory Action mailed in U.S. Appl. No. 11/566,630 dated Jun. 24, 2010, 3 pages.
Final Rejection mailed in U.S. Appl. No. 11/566,630 dated Mar. 11, 2010, 10 pages.
Non-Final Rejection mailed in U.S. Appl. No. 11/566,630 dated Sep. 9, 2009, 8 pages.
Requirement for Restriction / Election mailed in U.S. Appl. No. 11/566,630 dated Jun. 19, 2009, 6 pages.
Advisory Action mailed in U.S. Appl. No. 11/480,558 dated Oct. 30, 2009, 3 pages.
Final Rejection mailed in U.S. Appl. No. 11/480,558 dated Jul. 15, 2009, 9 pages.
Non-Final Rejection mailed in U.S. Appl. No. 11/480,558 dated Dec. 31, 2008, 14 pages.
Final Rejection mailed in U.S. Appl. No. 12/547,466 dated Jul. 12, 2010, 13 pages.
Non-Final Rejection mailed in U.S. Appl. No. 12/547,466 dated Jan. 28, 2010, 11 pages.
Advisory Action mailed in U.S. Appl. No. 10/819,130 dated May 6, 2008, 4 pages.
Advisory Action mailed in U.S. Appl. No. 10/819,130 dated Jul. 13, 2009, 3 pages.
Final Rejection mailed in U.S. Appl. No. 10/819,130 dated Jan. 25, 2008, 9 pages.
Final Rejection mailed in U.S. Appl. No. 10/819,130 dated Feb. 26, 2009, 7 pages.
Non-Final Rejection mailed in U.S. Appl. No. 10/819,130 dated Jun. 22, 2007, 8 pages.
Non-Final Rejection mailed in U.S. Appl. No. 10/819,130 dated Aug. 5, 2008, 8 pages.
Requirement for Restriction / Election mailed in U.S. Appl. No. 10/819,130 dated Apr. 3, 2007, 5 pages.
Advisory Action mailed in U.S. Appl. No. 10/821,184 dated Jun. 4, 2008, 4 pages.
Final Rejection mailed in U.S. Appl. No. 10/821,184 dated Nov. 21, 2008, 9 pages.
Final Rejection mailed in U.S. Appl. No. 10/821,184 dated Feb. 21, 2008, 14 pages.
Non-Final Rejection mailed in U.S. Appl. No. 10/821,184 dated Jun. 26, 2007, 11 pages.
Non-Final Rejection mailed in U.S. Appl. No. 10/821,184 dated Sep. 3, 2008, 14 pages.

* cited by examiner

AL—ZN—MG—CU ALLOY WITH IMPROVED DAMAGE TOLERANCE-STRENGTH COMBINATION PROPERTIES

CROSS-REFERENCE TO RELATED APPLICATIONS

This application is a divisional application of U.S. patent application Ser. No. 12/497,987 filed on 6 Jul. 2009 which is a continuation of application Ser. No. 10/821,184, filed on 9 Apr. 2004, claiming priority from provisional application No. 60/469,829 filed on 13 May 2003.

FIELD OF THE INVENTION

The invention relates to a wrought Al—Zn—Mg—Cu aluminium type (or 7000- or 7xxx-series aluminium alloys as designated by the Aluminum Association). More specifically, the present invention is related to an age-hardenable, high strength, high fracture toughness and highly corrosion resistant aluminium alloy and products made of that alloy. Products made from this alloy are very suitable for aerospace applications, but not limited to that. The alloy can be processed to various product forms, e.g. sheet, thin plate, thick plate, extruded or forged products.

In every product form, made from this alloy, property combinations can be achieved that are outperforming products made from nowadays known alloys. Because of the present invention, the uni-alloy concept can now be used also for aerospace applications. This will lead to significant cost reduction in the aerospace industry. Recycleability of the aluminium scrap produced during the production of the structural part or at the end of the life-cycle of the structural part will become significant easier because of the uni-alloy concept.

BACKGROUND OF THE INVENTION

Different types of aluminium alloys have been used in the past for forming a variety of products for structural applications in the aerospace industry. Designers and manufacturers in the aerospace industry are constantly trying to improve fuel efficiency, product performance and constantly trying to reduce the manufacturing and service costs. The preferred method for achieving the improvements, together with the cost reduction, is the uni-alloy concept, i.e. one aluminium alloy that is capable of having improved property balance in the relevant product forms.

The alloy members and temper designations used herein are in accordance with the well-known aluminium alloy product standards of the Aluminum Association. All percentages are in weight percents, unless otherwise indicated.

State of the art at this moment is high damage tolerant AA2×24 (i.e. AA2524) or AA6×13 or AA7×75 for fuselage sheet, AA2324 or AA7×75 for lower wing, AA7055 or AA7449 for upper wing and AA7050 or AA7010 or AA7040 for wing spars and ribs or other sections machined from thick plate. The main reason for using different alloys for each different application is the difference in the property balance for optimum performance of the whole structural part.

For fuselage skin, damage tolerant properties under tensile loading are considered to be very important, that is a combination of fatigue crack growth rate ("FCGR"), plane stress fracture toughness and corrosion. Based on these property requirements, high damage tolerant AA2×24-T351

(see e.g. U.S. Pat. No. 5,213,639 or EP-1026270-A1) or Cu containing AA6xxx-T6 (see e.g. U.S. Pat. Nos. 4,589,932, 5,888,320, US-2002/0039664-A1 or EP-1143027-A1) would be the preferred choice of civilian aircraft manufacturers.

For lower wing skin a similar property balance is desired, but some toughness is allowably sacrificed for higher tensile strength. For this reason AA2×24 in the T39 or a T8× temper are considered to be logical choices (see e.g. U.S. Pat. Nos. 5,865,914, 5,593,516 or EP-1114877-A1), although AA7×75 in the same temper is sometimes also applied.

For upper wing, where compressive loading is more important than the tensile loading, the compressive strength, fatigue (SN-fatigue or life-time) and fracture toughness are the most critical properties. Currently, the preferred choice would be AA7150, AA7055, AA7449 or AA7×75 (see e.g. U.S. Pat. Nos. 5,221,377, 5,865,911, 5,560,789 or 5,312,498). These alloys have high compressive yield strength with at the moment acceptable corrosion resistance and fracture toughness, although aircraft designers would welcome improvements on these property combinations.

For thick sections having a thickness of more than 3 inch or parts machined from such thick sections, a uniform and reliable property balance through thickness is important. Currently, AA7050 or AA7010 or AA7040 (see U.S. Pat. No. 6,027,582) or C80A (see US-2002/0150498-A1) are used for these types of applications. Reduced quench sensitivity, that is deterioration of properties through thickness with lower quenching speed or thicker products, is a major wish from the aircraft manufactures. Especially the properties in the ST-direction are a major concern of the designers and manufactures of structural parts.

A better performance of the aircraft, i.e. reduced manufacturing cost and reduced operation cost, can be achieved by improving the property balance of the aluminium alloys used in the structural part and preferably using only one type of alloy to reduce the cost of the alloy and to reduce the cost in the recycling of aluminium scrap and waste.

Accordingly, it is believed that there is a demand for an aluminium alloy capable of achieving the improved proper property balance in every relevant product form.

SUMMARY OF INVENTION

The present invention is directed to an AA7xxx-series aluminium alloy having the capability of achieving a property balance in any relevant product that is better than property balance of the variety of commercial aluminium alloys (AA2xxx, AA6xxx, AA7xxx) nowadays used for those products.

A preferred composition of the alloy of the present invention comprises or consists essentially of, in weight %, about 6.5 to 9.5 zinc (Zn), about 1.2 to 2.2% magnesium (Mg), about 1.0 to 1.9% copper (Cu), about 0 to 0.5% zirconium (Zr), about 0 to 0.7% scandium (Sc), about 0 to 0.4% chromium (Cr), about 0 to 0.3% hafnium (Hf), about 0 to 0.4% titanium (Ti), about 0 to 0.8% manganese (Mn), the balance being aluminium (Al) and other incidental elements. Preferably $(0.9\ Mg-0.6) \leq Cu \leq (0.9\ Mg+0.05)$.

A more preferred alloy composition according to the invention consists essentially of, in weight %, about 6.5 to 7.9% Zn, about 1.4 to 2.10% Mg, about 1.2 to 1.80% Cu, and preferably wherein $(0.9\ Mg-0.5) \leq Cu \leq 0.9\ Mg$, about 0 to 0.5% Zr, about 0 to 0.7% Sc, about 0 to 0.4% Cr, about 0 to 0.3% Hf, about 0 to 0.4% Ti, about 0 to 0.8% Mn, the balance being Al and other incidental elements.

A more preferred alloy composition according to the invention consists essentially of, in weight %, about 6.5 to 7.9% Zn, about 1.4 to 1.95% Mg, about 1.2 to 1.75% Cu, and preferably wherein (0.9 Mg-0.5)≤Cu≤(0.9 Mg-0.1), about 0 to 0.5% Zr, about 0 to 0.7% Sc, about 0 to 0.4% Cr, about 0 to 0.3% Hf, about 0 to 0.4% Ti, about 0 to 0.8% Mn, the balance being aluminium and other incidental elements.

In a more preferred embodiment, the lower limit for the Zn-content is 6.7%, and more preferably 6.9%.

In a more preferred embodiment, the lower limit for the Mg-content of 1.90%, and more preferably 1.92%. This lower-limit for the Mg-content is in particular preferred when the alloy product is being used for sheet product, e.g. fuselage sheet, and when used for sections made from thick plate.

The above mentioned aluminium alloys may contain impurities or incidental or intentionally additions, such as for example at most 0.3% Fe, preferably at most 0.14% Fe, at most 0.2% silicon (Si), and preferably at most 0.12% Si, at most 1% silver (Ag), at most 1% germanium (Ge), at most 0.4% vanadium (V). The other additions are generally governed by the 0.05-0.15 weight % ranges as defined in the Aluminium Association, thus each unavoidable impurity in a range of <0.05%, and the total of impurities <0.15%.

The iron and silicon contents should be kept significantly low, for example not exceeding about 0.08% Fe and about 0.07% Si or less. In any event, it is conceivable that still slightly higher levels of both impurities, at most about 0.14% Fe and at most about 0.12% Si may be tolerated, though on a less preferred basis herein. In particular for the mould plates or tooling plates embodiments hereof, even higher levels of at most 0.3% Fe and at most 0.2% Si or less, are tolerable.

The dispersoid forming elements like for example Zr, Sc, Hf, Cr and Mn are added to control the grain structure and the quench sensitivity. The optimum levels of dispersoid formers do depend on the processing, but when one single chemistry of main elements (Zn, Cu and Mg) is chosen within the preferred window and that chemistry will be used for all relevant product forms, then Zr levels are preferably less than 0.11%.

A preferred maximum for the Zr level is a maximum of 0.15%. A suitable range of the Zr level is a range of 0.04 to 0.15%. A more preferred upper-limit for the Zr addition is 0.13%, and even more preferably not more than 0.11%.

The addition of Sc is preferably not more than 0.3%, and preferably not more than 0.18%. When combined with Sc, the sum of Sc+Zr should be less then 0.3%, preferably less than 0.2%, and more preferably at a maximum of 0.17%, in particular where the ratio of Zr and Sc is between 0.7 and 1.4.

Another dispersoid former that can be added, alone or with other dispersoid formers is Cr. Cr levels should be preferable below 0.3%, and more preferably at a maximum of 0.20%, and even more preferably 0.15%. When combined with Zr, the sum of Zr+Cr should not be above 0.20%, and preferably not more than 0.17%.

The preferred sum of Sc+Zr+Cr should not be above 0.4%, and more preferably not more than 0.27%.

Also Mn can be added alone or in combination with one of the other dispersoid formers. A preferred maximum for the Mn addition is 0.4%. A suitable range for the Mn addition is in the range of 0.05 to 0.40%, and preferably in the range of 0.05 to 0.30%, and even more preferably 0.12 to 0.30%. A preferred lower limit for the Mn addition is 0.12%, and more preferably 0.15%. When combined with Zr, the sum of Mn+Zr should be less then 0.4%, preferably less than 0.32%, and a suitable minimum is 0.14%.

In another embodiment of the aluminium alloy product according to the invention the alloy is free of Mn, in practical terms this would mean that the Mn-content is <0.02%, and preferably <0.01%, and more preferably the alloy is essentially free or substantially free from Mn. With "substantially free" and "essentially free" we mean that no purposeful addition of this alloying element was made to the composition, but that due to impurities and/or leaching from contact with manufacturing equipment, trace quantities of this element may, nevertheless, find their way into the final alloy product.

In a particular embodiment of the wrought alloy product according to this invention, the alloy consists essentially of, in weight percent:

- Zn 7.2 to 7.7, and typically about 7.43
- Mg 1.79 to 1.92, and typically about 1.83
- Cu 1.43 to 1.52, and typically about 1.48
- Zr or Cr 0.04 to 0.15, preferably 0.06 to 0.10, and typically 0.08
- Mn optionally in a range of 0.05 to 0.19, and preferably 0.09 to 0.19, or in an alternative embodiment <0.02, preferably <0.01
- Si <0.07, and typically about 0.04
- Fe <0.08, and typically about 0.05
- Ti <0.05, and typically about 0.01 balance aluminium and inevitable impurities each <0.05, total <0.15.

In another particular embodiment of the wrought alloy product according to this invention, the alloy consists essentially of, in weight percent:

- Zn 7.2 to 7.7, and typically about 7.43
- Mg 1.90 to 1.97, preferably 1.92 to 1.97, and typically about 1.94
- Cu 1.43 to 1.52, and typically about 1.48
- Zr or Cr 0.04 to 0.15, preferably 0.06 to 0.10, and typically 0.08
- Mn optionally in a range of 0.05 to 0.19, and preferably of 0.09 to 0.19, or in an alternative embodiment <0.02, preferably <0.01
- Si <0.07, and typically about 0.05
- Fe <0.08, and typically about 0.06
- Ti <0.05, and typically about 0.01 balance aluminium and inevitable impurities each <0.05, total <0.15.

The alloy product according to the invention can be prepared by conventional melting and may be (direct chill, D.C.) cast into ingot form. Grain refiners such as titanium boride or titanium carbide may also be used. After scalping and possible homogenisation, the ingots are further processed by, for example extrusion or forging or hot rolling in one or more stages. This processing may be interrupted for an inter-anneal. Further processing may be cold working, which may be cold rolling or stretching. The product is solution heat treated and quenched by immersion in or spraying with cold water or fast cooling to a temperature lower than 95° C. The product can be further processed, for example by rolling or stretching, for example at most 8%, or may be stress relieved by stretching or compression at most about 8%, for example, from about 1 to 3%, and/or aged to a final or intermediate temper. The product may be shaped or machined to the final or intermediate structure, before or after the final ageing or even before solution heat treatment.

DETAILED DESCRIPTION OF THE INVENTION

The design of commercial aircraft requires different sets of properties for different types of structural parts. An alloy when processed to various product forms (i.e., sheet, plate, thick plate, forging or extruded profile etc.) and to be used in a wide variety of structural parts with different loading sequences in service life and consequently meeting different material requirements for all those product forms, must be unprecedentedly versatile.

The important material properties for a fuselage sheet product are the damage tolerant properties under tensile loads (i.e. FCGR, fracture toughness and corrosion resistance).

The important material properties for a lower wing skin in a high capacity and commercial jet aircraft are similar to those for a fuselage sheet product, but typically a higher tensile strength is wished by the aircraft manufactures. Also fatigue life becomes a major material property.

Because the airplane flies at high altitude where it is cold, fracture toughness at minus 65° F. is a concern in new designs of commercial aircrafts. Additional desirable features include age formability whereby the material can be shaped during artificial aging, together with good corrosion performance in the areas of stress corrosion cracking resistance and exfoliation corrosion resistance.

The important material properties for an upper wing skin product are the properties under compressive loads, i.e. compressive yield strength, fatigue life and corrosion resistance.

The important material properties for machined parts from thick plate depend on the machined part. But, in general, the gradient in material properties through thickness must be very small and the material properties like strength, fracture toughness, fatigue and corrosion resistance must be a high level.

The present invention is directed at an alloy composition when processed to a variety of products, such as, but not limited to, sheet, plate, thick plate etc, will meet or exceed the desired material properties. The property balance of the product will out-perform the property balance of the product made from nowadays commercially used alloys.

It has been found very surprisingly a chemistry window within the AA7000 window, unexplored before, that does fulfil this unique capability.

The present invention resulted from an investigation on the effect of Cu, Mg and Zn levels, combined with various levels and types of dispersoid former (e.g. Zr, Cr, Sc, Mn) on the phases formed during processing. Some of these alloys were processed to sheet and plate and tested on tensile, Kahn-tear toughness and corrosion resistance. Interpretations of these results lead to the surprising insight that an aluminium alloy with a chemical composition within a certain window, will exhibit excellent properties as well as for sheet as for plate as for thick plate as for extrusions as for forgings.

In another aspect of the invention there is provided a method of manufacturing the aluminium alloy product according to the invention. The method of manufacturing a high-strength, high-toughness AA7000-series alloy product having a good corrosion resistance, comprising the processing steps of:

a.) casting an ingot having a composition as set out in the present description;

b.) homogenising and/or pre-heating the ingot after casting;

c.) hot working the ingot into a pre-worked product by one or more methods selected from the group consisting of: rolling, extruding and forging;

d.) optional reheating the pre-worked product and either, e.) hot working and/or cold working to a desired workpiece form;

f.) solution heat treating (SHT) the formed workpiece at a temperature and time sufficient to place into solid solution essentially all soluble constituents in the alloy;

g.) quenching the solution heat treated workpiece by one of spray quenching or immersion quenching in water or other quenching media;

h.) optionally stretching or compressing of the quenched work piece or otherwise cold worked to relieve stresses, for example levelling of sheet products;

i.) artificially ageing the quenched and optionally stretched or compressed workpiece to achieve a desired temper, for example, the tempers selected from the group comprising: T6, T74, T76, T751, T7451, T7651, T77 and T79.

The alloy products of the present invention are conventionally prepared by melting and may be direct chill (D.C.) cast into ingots or other suitable casting techniques. Homogenisation treatment is typically carried out in one or multi steps, each step having a temperature preferably in the range of 460 to 490° C. The pre-heat temperature involves heating the rolling ingot to the hot-mill entry temperature, which is typically in a temperature range of 400 to 460° C. Hot working the alloy product can be done by one or more methods selected from the group consisting of rolling, extruding and forging. For the present alloy hot rolling is being preferred. Solution heat treatment is typically carried out in the same temperature range as used for homogenisation, although the soaking times can be chosen somewhat shorter.

In an embodiment of the method according to the invention the artificial ageing step i.) comprises a first ageing step at a temperature in a range of 105° C. to 135° C. preferably for 2 to 20 hours, and a second ageing step at a temperature in a range of 135° C. to 210° C. preferably for 4 to 20 hours. In a further embodiment a third ageing step may be applied at a temperature in a range of 105° C. to 135° C. and preferably for 20 to 30 hours.

A surprisingly excellent property balance is being obtained in whatever thickness is produced. In the sheet thickness range of at most 1.5 inch the properties will be excellent for fuselage sheet, and preferably the thickness is at most 1 inch. In the thin plate thickness range of 0.7 to 3 inch the properties will be excellent for wing plate, e.g. lower wing plate. The thin plate thickness range can be used also for stringers or to form an integral wing panel and stringer for use in an aircraft wing structure. More peak-aged material will give an excellent upper wing plate, whereas slightly more over-ageing will give excellent properties for lower wing plate. When processed to thicker gauges of more than 2.5 inch up to about 11 inch or more excellent properties will be obtained for integral parts machined from plates, or to form an integral spar for use in an aircraft wing structure, or in the form of a rib for use in an aircraft wing structure. The thicker gauge products can be used also as tooling plate or mould plate, e.g. moulds for manufacturing formed plastic products, for example via die-casting or injection moulding. When thickness ranges are given hereinabove, it will be immediately apparent to the skilled person that this is the thickness of the thickest cross sectional point in the alloy product made from such a sheet, thin plate or thick plate. The alloy products according to the invention can also be provided in the form of a stepped extrusion or extruded spar for use in an aircraft structure, or in the form of a forged spar for use in an aircraft wing structure.

Surprisingly, all these products with excellent properties can be obtained from one alloy with one single chemistry.

In the embodiment whereby structural components, e.g. ribs, are made from the alloy product according to the invention having a thickness of 2.5 inch or more, the component increased elongation compared to its AA7050 aluminium alloy counterpart. In particular the elongation (or A50) in the ST testing direction is 5% or more, and in the best results 5.5% or more.

Furthermore, in the embodiment whereby structural components are made from the alloy product according to the invention having a thickness of 2.5 inch or more, the component has a fracture toughness Kapp in the L-T testing direction at ambient room temperature and when measured at S/4 according to ASTM E561 using 16-inch centre cracked panels (M(T) or CC(T)) showing an at least 20% improvement compared to its AA7050 aluminium alloy counterpart, and in the best examples an improvement of 25% or more is found.

In the embodiment where the alloy product has been extruded, preferably the alloy products have been extruded into profiles having at their thickest cross sectional point a thickness in the range of up to 10 mm, and preferably in the range of 1 to 7 mm. However, in extruded form the alloy product can also replace thick plate material which is conventionally machined via high-speed machining or milling techniques into a shaped structural component. In this embodiment the extruded alloy product has preferably at its thickest cross sectional point a thickness in a range of 2 to 6 inches.

BRIEF DESCRIPTION OF THE DRAWINGS

FIG. 1 shows schematically the ranges for the Cu and Mg for the alloy according to the present invention in their preferred embodiments as set out in dependent claims 2 to 4. Also shown are two narrower more preferred ranges. The ranges can also be identified by using the corner-points A, B, C, D, E, and F of a hexagon box. Preferred ranges are identified by A' to F', and more preferred ranges by A" to F". The coordinates are listed in Table 1. In FIG. 1 also the alloy composition according to this invention as mentioned in the examples hereinafter are illustrated as individual points.

TABLE 1

Figure 1:
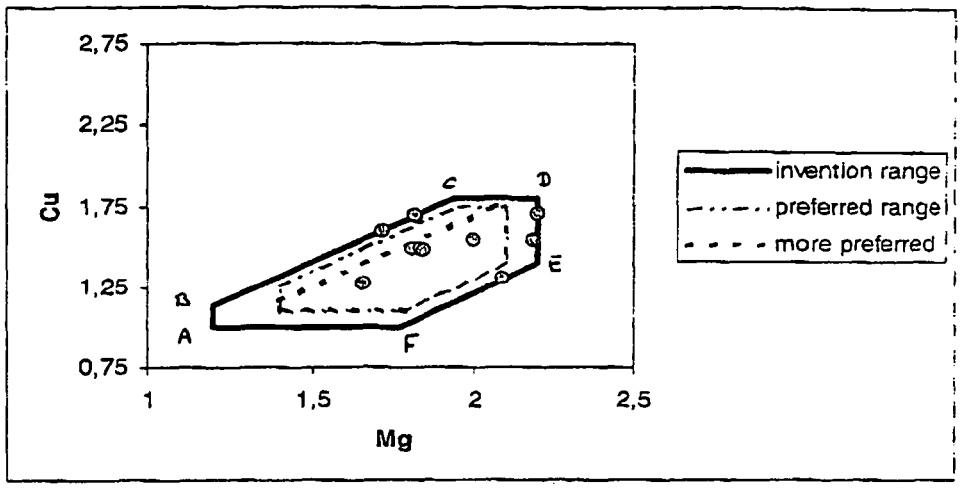
FIG. 1 is an Mg—Cu diagram setting out the Cu—Mg range for the alloy according to this invention, together with narrower preferred ranges.

Coordinates (in wt. %) for the corner-points of the Cu—Mg ranges for the preferred ranges of the alloy product according to the invention.

| Corner point | (Mg, Cu) wide range | Corner point | (Mg, Cu) preferred range | Corner point | (Mg, Cu) more preferred range |
|---|---|---|---|---|---|
| A | 1.20, 1.00 | A' | 1.40, 1.10 | A" | 1.40, 1.10 |
| B | 1.20, 1.13 | B' | 1.40, 1.26 | B" | 1.40, 1.16 |

TABLE 1-continued

Coordinates (in wt. %) for the corner-points of the Cu—Mg ranges for the preferred ranges of the alloy product according to the invention.

| Corner point | (Mg, Cu) wide range | Corner point | (Mg, Cu) preferred range | Corner point | (Mg, Cu) more preferred range |
|---|---|---|---|---|---|
| C | 2.05, 1.90 | C' | 2.05, 1.80 | C" | 2.05, 1.75 |
| D | 2.20, 1.90 | D' | 2.10, 1.80 | D" | 2.10, 1.75 |
| E | 2.20, 1.40 | E' | 2.10, 1.40 | E" | 2.10, 1.40 |
| F | 1.77, 1.00 | F' | 1.78, 1.10 | F" | 1.87, 1.10 |

EXAMPLES

Example 1

On a laboratory scale alloys were cast to prove the principle of the current invention and processed to 4.0 mm sheet or 30 mm plate. The alloy compositions are listed in Table 2, for all ingots Fe<0.06, Si<0.04, Ti 0.01, balance aluminium. Rolling blocks of approximately 80 by 80 by 100 mm (height×width×length) were sawn from round lab cast ingots of about 12 kg. The ingots were homogenised at 460±5° C. for about 12 hrs and consequently at 475±5° C. for about 24 hrs and consequently slowly air cooled to mimic an industrial homogenisation process. The rolling ingots were pre-heated for about 6 hrs at 410±5° C. At an intermediate thickness range of about 40 to 50 mm the blocks were re-heated at 410±5° C. Some blocks were hot rolled to the final gauge of 30 mm, others were hot rolled to a final gauge of 4.0 mm. During the whole hot-rolling process, care was taken to mimic an industrial scale hot rolling. The hot-rolled products were solution heat treated and quenched. Most were quenched in water, but some were also quenched in oil to mimic the mid and quarter-thickness quenching-rate of a 6-inch thick plate. The products were cold stretched by about 1.5% to relieve the residual stresses. The ageing behaviour of the alloys was investigated. The final products were over-aged to a near peak aged strength (e.g. T76 or T77 temper).

Tensile properties have been tested according EN10.002. The tensile specimens from the 4 mm thick sheet were flat EURO-NORM specimen with 4 mm thickness. The tensile specimens from the 30 mm plate were round tensile specimens taken from mid-thickness. The tensile test results in Table 1 are from the L-direction. The Kahn-tear toughness is tested according to ASTM B871-96. The test direction of the results on Table 2 is the T-L direction. The so-called notch-toughness can be obtained by dividing the tear-strength, obtained by the Kahn-tear test, by the tensile yield strength ("TS/Rp"). This typical result from the Kahn-tear test is known in the art to be a good indicator for true fracture toughness. The unit propagation energy ("UPE"), also obtained by the Kahn-tear test, is the energy needed for crack growth. It is believed that the higher the UPE, the more difficult to grow the crack, which is a desired feature of the material.

To qualify for a good corrosion performance, the exfoliation corrosion resistance ("EXCO") when measured according to ASTM G34-97 must be at least "EA" or better. The inter-granular corrosion ("IGC") when measured according MIL-H-6088 is preferable absent. Some pitting is acceptable, but preferably should be absent also.

In order to have a promising candidate alloy suitable for a variety of products, it had to fulfil the following requirements on lab-scale: A tensile yield strength of at least 510 MPa, an ultimate strength of at least 560 MPa, a notch toughness of at least 1.5 and a UPE of at least 200 kJ/m$^2$. The results for the various alloys as function of some processing are listed in Table 2 also.

In order to meet all those desired material properties, the chemistry of the alloy has to be carefully balanced. According to the present results, too high values for Cu, Mg and Zn contents were found to be detrimental to toughness and corrosion resistance. Whereas too low values were found to be detrimental for high strength levels.

TABLE 2

| Specimen No. | Invention Alloy (Y/N) | Thickness (mm) | Temper | Mg (wt %) | Cu (wt %) | Zn (wt %) | Zr (wt %) | Others (wt %) | Rp (MPa) | Rm (MPa) | UPE (kJ/m$^2$) | Ts/Rp |
|---|---|---|---|---|---|---|---|---|---|---|---|---|
| 1 | yes | 30 | T77 | 1.84 | 1.47 | 7.4 | 0.10 | — | 587 | 627 | 312 | 1.53 |
| 2 | yes | 30 | T76 | 1.66 | 1.27 | 8.1 | 0.09 | — | 530 | 556 | 259 | 1.76 |
| 3 | yes | 4 | T76 | 2.00 | 1.54 | 6.8 | 0.11 | — | 517 | 563 | 297 | 1.62 |
| 4 | no | 4 | T76 | 2.00 | 1.52 | 5.6 | 0.01 | 0.16 Cr | 473 | 528 | 232 | 1.45 |
| 5 | no | 4 | T76 | 2.00 | 1.53 | 5.6 | 0.06 | 0.08 Cr | 464 | 529 | 212 | 1.59 |
| 6 | yes | 4 | T76 | 1.82 | 1.68 | 7.4 | 0.10 | — | 594 | 617 | 224 | 1.44 |
| 7 | yes | 30 | T76 | 2.09 | 1.30 | 8.2 | 0.09 | — | 562 | 590 | 304 | 1.64 |
| 8 | yes | 4 | T77 | 2.20 | 1.70 | 8.7 | 0.11 | — | 614 | 626 | 115 | 1.38 |
| 9 | yes | 4 | T77 | 1.81 | 1.69 | 8.7 | 0.10 | — | 574 | 594 | 200 | 1.47 |
| 10 | no | 4 | T76 | 2.10 | 1.54 | 5.6 | 0.07 | — | 490 | 535 | 245 | 1.53 |
| 11 | no | 4 | T76 | 2.20 | 1.90 | 6.7 | 0.10 | — | 563 | 608 | — | 1.07 |
| 12 | no | 4 | T76 | 1.98 | 1.90 | 6.8 | 0.09 | — | 559 | 592 | — | 1.32 |
| 13 | no | 4 | T77 | 2.10 | 2.10 | 8.6 | 0.10 | — | 623 | 639 | 159 | 1.31 |
| 14 | no | 4 | T77 | 2.50 | 1.70 | 8.7 | 0.10 | — | 627 | 643 | 117 | 1.33 |
| 15 | no | 4 | T77 | 1.70 | 2.10 | 8.6 | 0.12 | — | 584 | 605 | 139 | 1.44 |
| 16 | no | 4 | T77 | 1.70 | 2.40 | 8.6 | 0.11 | — | 598 | 619 | 151 | 1.42 |
| 17 | no | 4 | T76 | 2.40 | 1.54 | 5.6 | 0.01 | — | 476 | 530 | 64 | 1.42 |
| 18 | no | 4 | T76 | 2.30 | 1.54 | 5.6 | 0.07 | — | 488 | 542 | 52 | 1.54 |
| 19 | no | 4 | T76 | 2.30 | 1.52 | 5.5 | 0.14 | — | 496 | 543 | 155 | 1.66 |
| 20 | yes | 4 | T76 | 2.19 | 1.54 | 6.7 | 0.11 | 0.16 Mn | 521 | 571 | 241 | 1.65 |
| 21 | no | 4 | T76 | 2.12 | 1.51 | 5.6 | 0.12 | — | 471 | 516 | 178 | 1.42 |

But, very surprisingly, a higher Zn-level is increasing the toughness and crack growth resistance. Therefore, it is desirable to use higher Zn level and combine these with lower Mg and Cu levels. It has been found that the Zn-content should not be below 6.5%, and preferably not below 6.7%, and more preferably not below 6.9%.

Mg is required to have acceptable strength levels. It has been found that a ratio of Mg/Zn of about 0.27 or lower seems to give the best strength-toughness combination. However, Mg levels should not exceed 2.2%, and preferably not exceed 2.1%, and even more preferably not exceed 1.97%, with a more preferred upper level of 1.95%. This upper-limit is lower than in the conventional AA-windows or ranges of presently used commercial aerospace alloys like AA7050, AA7010 and AA7075.

In order to have a desirably very high crack growth resistance (or UPE) Mg levels must be carefully balanced and should preferably be in the same order or slightly more than the Cu levels, and preferably $(0.9\times Mg-0.6)\leq Cu\leq(0.9\times Mg+0.05)$. The Cu-content should not be too high. It has been found that the Cu-content should not be higher than 1.9%, and preferably should not exceed 1.80%, and more preferably not exceed 1.75%.

The dispersoid formers used in AA7xxx-series alloys are typically Cr, as in e.g. AA7×75, or Zr, as in e.g. AA7×50 and AA7×10. Conventionally, Mn is believed to be detrimental for toughness, but much to our surprise, a combination of Mn and Zr shows still a very good strength-toughness balance.

Example 2

A batch of full-size rolling ingots with a thickness of 440 mm thick on an industrial scale were produced by a DC-casting and having the chemical composition (in wt. %): 7.43% Zn, 1.83% Mg, 1.48% Cu, 0.08% Zr, 0.02% Si and 0.04% Fe, balance aluminium and unavoidable impurities. One of these ingots was scalped, homogenised at 12 hrs/470° C.+24 hrs/475° C.+air cooled to ambient temperature. This ingot was pre-heated at 8 hrs/410° C. and then hot rolled to about 65 mm. The rolling block was then turned 90 degrees and further hot rolled to about 10 mm. Finally the rolling block was cold rolled to a gauge of 5.0 mm. The obtained sheet was solution heat treated at 475° C. for about 40 minutes, followed by water-spray quenching. The resultant sheets were stress relieved by a cold stretching operation of about 1.8%. Two ageing variants have been produced, variant A: for 5 hrs/120° C.+9 hrs/155° C., and variant B: for 5 hrs/120° C.+9 hrs/165° C.

The tensile results have been measured according to EN 10.002. The compression yield strength ("CYS") has been measured according to ASTM E9-89a. The shear strength has been measured according to ASTM B831-93. The fracture toughness, Kapp, has been measured according to ASTM E561-98 on 16-inch wide centre cracked panels [M(T) or CC(T)]. The Kapp has been measured at ambient room temperature (RT) and at −65° F. As reference material a high damage tolerant ("HDT") AA2×24-T351 has been tested as well. The results are listed in Table 3.

TABLE 3

| | Ageing | L-TYS (MPa) | LT-TYS (MPa) | L-UTS (MPa) | LT-UTS (MPa) | L-T CYS (MPa) | T-L CYS (MPa) |
|---|---|---|---|---|---|---|---|
| INV | Variant A | 544 | 534 | 562 | 559 | 554 | 553 |
| INV | Variant A | 489 | 472 | 526 | 512 | 492 | 500 |

TABLE 3-continued

| | | | | | | | |
|---|---|---|---|---|---|---|---|
| HDT-2x24 | T351 | 360 | 332 | 471 | 452 | 329 | 339 |

| | Ageing | L-T Shear (MPa) | T-L Shear (MPa) | RT L-T Kapp MPa · m | RT T-L Kapp MPa · $m^{0.5}$ | −65° F. L-T Kapp MPa · $m^{0.5}$ | −65° F. L-T Kapp MPa · $m^{0.5}$ |
|---|---|---|---|---|---|---|---|
| INV | Variant A | 372 | 373 | 103 | 100 | — | — |
| INV | Variant B | 340 | 338 | 132 | 127 | 102 | 103 |
| HDT-2x24 | T351 | 328 | 312 | — | 101 | — | 103 |

The exfoliation corrosion resistance has been measured according ASTM G34-97. Both variant A and B showed EA rating.

The inter-granular corrosion measured according to MIL-H-6088 for variant A was about 70 μm and for variant B about 45 μm. Both are significantly lower than the typical 200 μm as measured for the reference AA2×24-T351.

From Table 3 it can be seen that there is a significant improvement with the alloy according to the invention. A significant increase in strength at comparable or even higher fracture toughness levels. Also the alloy according to the invention at a low temperature of minus 65° F., outperforms the nowadays standard high damage tolerant fuselage alloy AA2×24-T351. Note that also the corrosion resistance of the inventive alloy is significant better than the AA2×24-T351.

The fatigue crack growth rate ("FCGR") has been measured according to ASTM E647-99 on 4-inch wide compact tension panels [C(T)] with an R-ratio of 0.1. In Table 3 the da/dn per cycle at a stress range of $\Delta K=27.5$ ksi·$in^{0.5}$ (=about 30 MPa·$m^{0.5}$) of the inventive alloy has been compared with the reference high damage tolerant AA2×24-T351.

It can be clearly seen from the results in Table 4 that the crack growth of the inventive alloy is better than that of the high damage tolerant AA2×24-T351.

TABLE 4

| Crack growth per cycle at a stress range of deltaK = 27.5 ksi $in^{0.5}$ | | | |
|---|---|---|---|
| INV | Variant A | L-T | 96% |
| INV | Variant A | T-L | 84% |
| INV | Variant B | L-T | 73% |
| INV | Variant B | T-L | 74% |
| HDT-2x24 | T351 | L-T | 100% |

Example 3

Another full-scale ingot taken from the batch DC-cast from Example 2 was produced into a plate of 6-inch thickness. Also this ingot was scalped, homogenised at 12 hrs/470° C.+24 hrs/475° C.+air cooled to ambient temperature. The ingot was pre-heated at 8 hrs/410° C. and then hot rolled to about 152 mm. The obtained hot-rolled plate was solution heat treated at 475° C. for about 7 hours followed by water-spray quenching. The plates were stress relieved by a cold stretching operation of about 2.0%. Several different two-step ageing processes have been applied.

The tensile results have been measured according to EN 10.002. The specimens were taken from the T/4-position. The plane strain fracture toughness, Kq, has been measured according to ASTM E399-90. If the validity requirements as given in ASTM E399-90 are met, these Kq values are a real material property and called $K_{1C}$. The $K_{1C}$ has been measured at ambient room temperature ("RT"). The exfoliation corrosion resistance has been measured according to ASTM G34-97. The results are listed in Table 5. All ageing variants as shown in Table 5 showed "EA" rating.

Figure 2:
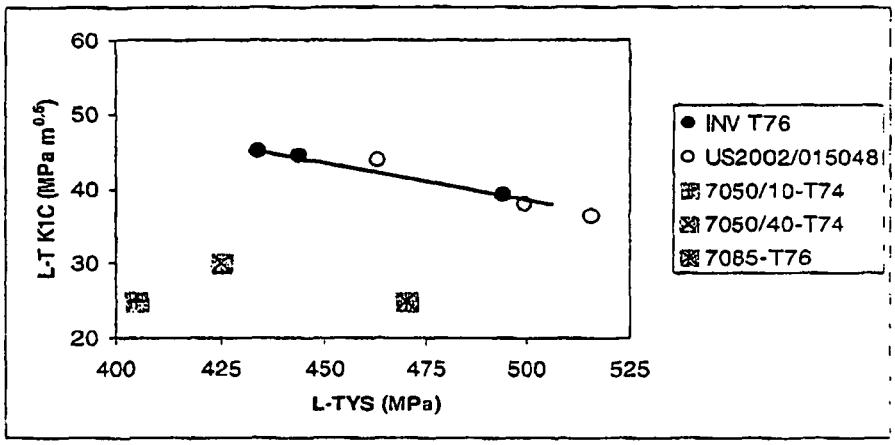
FIG. 2 is a diagram comparing the fracture toughness vs. the tensile yield strength for the alloy product according to the invention against several references.

In FIG. 2 a comparison is given versus results presented in US-2002/0150498-A1, Table 2, incorporated herein by reference. In this US patent application an example (example 1) is given of a similar product, but with a different chemistry that is stated to be optimised for quench sensitivity. In our inventive alloy we have obtained a similar tensile versus toughness balance as in this US patent application. However, our inventive alloys shows at least superior EXCO resistance.

Furthermore, also the elongation of our inventive alloy is superior to that disclosed in US2002/0150498-A1, Table 2. The overall property balance of alloy according to the present invention when processed to 6-inch thick plate is better than that disclosed in US-2002/0150498-A1. In FIG. 2 also documented data for thick gauges of 75 to 220 mm are shown for the AA7050/7010 alloy (see AIMS03-02-022, December 2001), the AA7050/7040 alloy (see AIMS03-02-019, September 2001), and the AA7085 alloy (see AIMS03-02-025, September 2002).

TABLE 5

| Ageing process | L-TYS (MPa) | L-UTS (MPa) | L-A50 (%) | L-T K1C (MPa · $m^{0.5}$) | EXCO |
|---|---|---|---|---|---|
| 5 hrs/120° C. + 11 hrs/165° C. | 453 | 497 | 9.9 | — | EA |
| 5 hrs/120° C. + 13 hrs/165° C. | 444 | 492 | 12.5 | 44.4 | EA |
| 5 hrs/120° C. + 15 hrs/165° C. | 434 | 485 | 13.0 | 45.0 | EA |
| 5 hrs/120° C. + 12 hrs/160° C. | 494 | 523 | 10.5 | 39.1 | EA |
| 5 hrs/120° C. + 14 hrs/160° C. | 479 | 213 | 8.3 | — | EA |

Example 4

Another full-scale ingot taken from the batch DC-cast from Example 2 was produced to plates of respectively 63.5 mm and 30 mm thickness. The cast ingot was scalped, homogenised at 12 hrs/470° C.+24 hrs/475° C.+air cooled to ambient temperature. The ingot was pre-heated at 8 hrs/410° C. and then hot rolled to respectively 63.5 and 30 mm. The obtained hot-rolled plates were solution heat treated (SHT) at 475° C. for about 2 to 4 hrs followed by water-spray quenching. The plates were stress relieved by a cold stretching operation of respectively 1.7% and 2.1% for the 63.5 mm and 30 mm plates. Several different two-step ageing processes have been applied.

The tensile results have been measured according to EN 10.002. The plane strain fracture toughness, Kq, has been measured according to ASTM E399-90 on CT-specimens. If the validity requirements as given in ASTM E399-90 are met, these Kq values are a real material property and called $K_{1C}$. The $K_{1C}$ has been measured at ambient room temperature ("RT"). The EXCO exfoliation corrosion resistance has been measured according to ASTM G34-97. The results are listed in Table 6. All ageing variants as shown in Table 6 showed "EA"-rating.

TABLE 6

| Thickness (mm) | Ageing (° C.-hrs) | TYS MPa L-direction | UTS MPa L-direction | A50 (%) L-direction | L-T K1C MPa · vm | TYS (MPa) LT-direction | UTS (MPa) LT-direction | A50 (%) LT-direction | T-L K1C MPa · $m^{0.5}$ |
|---|---|---|---|---|---|---|---|---|---|
| 63.5 | 120-5/150-12 | 566 | 594 | 10.7 | 42.4 | 532 | 572 | 9.8 | 32.8 |
| 63.5 | 120-5/155-12 | 566 | 599 | 11.9 | 40.7 | 521 | 561 | 11.2 | 33.0 |
| 63.5 | 120-5/160-12 | 528 | 569 | 13.0 | 51.6 | 497 | 516 | 11.6 | 40.2 |
| 30 | 120-5/150-12 | 565 | 590 | 14.2 | 46.9 | 558 | 582 | 13.9 | 36.3 |
| 30 | 120-5/155-12 | 557 | 589 | 14.4 | 51.0 | 547 | 572 | 13.6 | 39.2 |
| 30 | 120-5/160-12 | 501 | 548 | 15.1 | 65.0 | 493 | 539 | 14.3 | 46.8 |

In Table 7 the values are given of nowadays state of the art commercial upper wing alloys, and are typical data according to the supplier of that material (Alloy 7150-T7751 plate & 7150-T77511 extrusions, Alcoa Mill products, Inc., ACRP-069-B).

TABLE 7

Typical values from ALCOA tech sheet on AA7150-T77 and AA7055-T77, both plates of 25 mm.

| Thickness (mm) | Ageing | TYS MPa L-direction | UTS MPa L-direction | A50 (%) L-direction | L-T KIC MPa · $m^{0.5}$ | TYS (MPa) LT-direction | UTS (MPa) LT-direction | A50 (%) LT-direction | T-L KIC MPa · $m^{0.5}$ |
|---|---|---|---|---|---|---|---|---|---|
| 25 | 7150-T77 | 572 | 607 | 12.0 | 29.7 | 565 | 607 | 11.0 | 26.4 |
| 25 | 7055-T77 | 614 | 634 | 11.0 | 28.6 | 614 | 641 | 10.0 | 26.4 |

Figure 3:
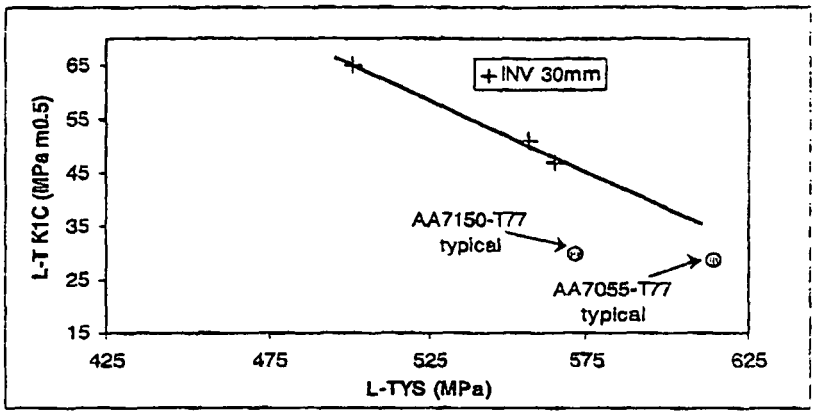
FIG. 3 is a diagram comparing the fracture toughness vs. the tensile yield strength for the alloy product according to this invention in a 30 mm gauge against two references.

In FIG. 3 a comparison is given of the inventive alloy versus AA7150-T77 and AA7055-T77. From FIG. 3 it can be clearly seen that the tensile versus toughness balance of the current inventive alloy is superior to commercial available AA7150-T77 and also to AA7055-T77.

Example 5

Another full-scale ingot taken from the batch DC-cast from Example 2 (hereinafter in Example 5 "Alloy A") was produced to plates of 20 mm thickness. Also one other casting was made (designated "Alloy B" for this example) with a chemical composition (in wt. %): 7.39% Zn, 1.66% Mg, 1.59% Cu, 0.08% Zr, 0.03% Si and 0.04% Fe, balance aluminium and unavoidable impurities. These ingots were scalped, homogenised at 12 hrs/470° C.+24 hrs/475° C.+air cooled to ambient temperature. For further processing, three different routes were used.

Route 1: The ingots of alloy A and B were pre-heated at 6 hrs/420° C. and then hot rolled to about 20 mm.

Route 2: Ingot of alloy A were pre-heated at 6 hrs/460° C. and then hot rolled to about 20 mm.

Route 3: Ingot of alloy B were pre-heated at 6 hrs/420° C. and then hot rolled to about 24 mm, subsequently these plates were cold rolled to 20 mm.

Thus, four variants were produced and identified as: A1, A2, B1 and B3. The resultant plates were solution heat treated at 475° C. for about 2 to 4 hrs followed by water-spray quenching. The plates were stress relieved by a cold stretching operation of about 2.1%. Several different two-step ageing processes have been applied, whereby for example "120-5/150-10" means 5 hrs at 120° C. followed by 10 hrs at 150° C.

The tensile results have been measured according to EN 10.002. The plane strain fracture toughness, Kq, has been measured according to ASTM E399-90 on CT specimens. If the validity requirements as given in ASTM E399-90 are met, these Kq values are a real material property and called $K_{1C}$ or KIC. Note that most of the fracture toughness measurement in this example failed the meet the validity criteria on specimen thickness. The reported Kq values are a conservative with respect to $K_{1C}$, in other words, the reported Kq values are in fact generally lower than the standard $K_{1C}$ values obtained when specimen size related validity criteria of ASTM E399-90 are satisfied. The exfoliation corrosion resistance has been measured according to ASTM G34-97. The results are listed in Table 8. All ageing variants as shown in Table 8 showed "EA"-rating for the EXCO resistance.

Figure 4:
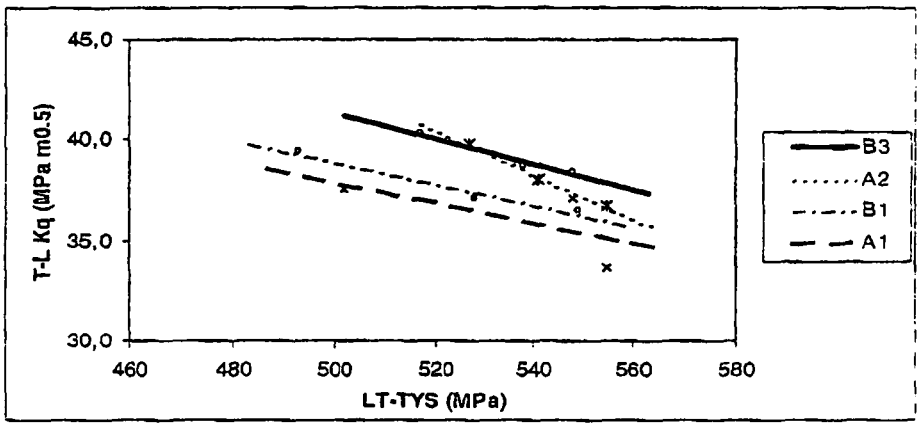
FIG. 4 is a diagram comparing the plane strain fracture toughness vs. the tensile yield strength for the alloy products according to the invention using different processing routes.

The results of Table 8 have are shown graphically in FIG. 4. In FIG. 4 lines have been fitted through the data to get an impression of the differences between A1, A2, B1 and B3. From that graph it can be clearly seen that alloy A and B, when comparing A1 and B1, have a similar strength versus toughness behaviour. The best strength versus toughness could be obtained by either B3 (i.e. cold rolling to final thickness) or by A2 (i.e. pre-heat at a higher temperature). Also note that the results of Table 8 show a significant better strength versus toughness balance than AA7150-T77 and AA7055-T77 as listed in Table 7.

TABLE 8

| Alloy | Ageing (° C.-hrs) | TYS MPa | UTS (MPa) | A50 (%) | TYS MPa | UTS MPa | A50 (%) | T-L KIC MPa · m$^{0.5}$ |
|---|---|---|---|---|---|---|---|---|
| | | L-direction | | | LT-direction | | | |
| B3 | 120-5/150-10 | 563 | 586 | 13.7 | 548 | 581 | 12.5 | 38.4 |
| B3 | 120-5/155-12 | 558 | 581 | 14.4 | 538 | 575 | 13.1 | 38.7 |
| B3 | 120-5/160-10 | 529 | 563 | 14.6 | 517 | 537 | 13.7 | 40.3 |
| B1 | 120-5/150-10 | 571 | 595 | 13.4 | 549 | 581 | 13.4 | 36.5 |

TABLE 8-continued

| Alloy | Ageing (° C.-hrs) | TYS MPa | UTS (MPa) | A50 (%) | TYS MPa | UTS MPa | A50 (%) | T-L KIC MPa · m$^{0.5}$ |
|---|---|---|---|---|---|---|---|---|
| | | L-direction | | | LT-direction | | | |
| B1 | 120-5/155-12 | 552 | 582 | 14.3 | 528 | 568 | 13.9 | 37.1 |
| B1 | 120-5/160-12 | 510 | 552 | 15.1 | 493 | 542 | 14.5 | 39.4 |
| A1 | 120-5/150-10 | 574 | 597 | 13.7 | 555 | 590 | 14.0 | 33.7 |
| A1 | 120-5/155-12 | 562 | 594 | 14.4 | 548 | 586 | 13.9 | 37.1 |
| A1 | 120-5/160-12 | 511 | 556 | 15.0 | 502 | 550 | 14.3 | 37.6 |
| A2 | 120-5/150-10 | 574 | 600 | 14.0 | 555 | 595 | 13.9 | 36.7 |
| A2 | 120-5/155-12 | 552 | 584 | 14.3 | 541 | 582 | 13.1 | 38.0 |
| A2 | 120-5/160-12 | 532 | 572 | 14.8 | 527 | 545 | 12.4 | 39.8 |

Example 6

On an industrial scale two alloys have been cast via DC-casting with a thickness of 440 mm and processed into sheet product of 4 mm. The alloy compositions are listed in Table 9, whereby alloy B represents an alloy composition according to a preferred embodiment of the invention when the alloy product is in the form of a sheet product.

The ingots were scalped, homogenized at 12 hrs/470° C.+24 hrs/475° C. and then hot rolled to an intermediate gauge of 65 mm and final hot rolled to about 9 mm. Finally the hot rolled intermediate products have been cold rolled to a gauge of 4 mm. The obtained sheet products were solution heat treated at 475° C. for about 20 minutes, followed by water-spray quenching. The resultant sheets were stress relieved by a cold stretching operation of about 2%. The stretched sheets have been aged thereafter for 5 hrs/120° C.+8 hrs/165° C. Mechanical properties have tested analogue to Example 1 and the results are listed in Table 10.

The results of this full-scale trial confirm the results of Example 1 that the positive addition of Mn in the defined range significantly improves the toughness (both UPE and Ts/Rp) of the sheet product resulting in a very good and desirable strength-toughness balance.

TABLE 9

Chemical composition of the alloys tested, balance impurities and aluminium

| Alloy | Si | Fe | Cu | Mn | Mg | Zn | Ti | Zr |
|---|---|---|---|---|---|---|---|---|
| A | 0.03 | 0.08 | 1.61 | — | 1.86 | 7.4 | 0.03 | 0.08 |
| B | 0.03 | 0.06 | 1.59 | 0.07 | 1.96 | 7.36 | 0.03 | 0.09 |

TABLE 10

Mechanical properties of the alloy products tested for two testing directions.

| Alloy | L-direction Rp MPa | Rm MPa | A50 (%) | TS | UPE | Ts/Rp | LT-direction Rp MPa | Rm | A50 (%) | TS | UPE | Ts/Rp |
|---|---|---|---|---|---|---|---|---|---|---|---|---|
| A | 497 | 534 | 11.0 | 694 | 90 | 1.40 | 479 | 526 | 12.0 | 712 | 134 | 1.49 |
| B | 480 | 527 | 12.9 | 756 | 152 | 1.58 | 477 | 525 | 12.8 | 712 | 145 | 1.49 |

Example 7

On an industrial scale two alloys have been cast via DC-casting with a thickness of 440 mm and processed into a plate product having a thickness of 152 mm. The alloy compositions are listed in Table 11, whereby alloy C represents a typical alloy falling within the AA7050-series range and alloy D represents an alloy composition according to a preferred embodiment of the invention when the alloy product is in the form of plate, e.g. thick plate.

The ingots were scalped, homogenized in a two-step cycle of 12 hrs/470° C.+24 hrs/475° C. and air cooled to ambient temperature. The ingot was pre-heated at 8 hrs/410° C. and then hot rolled to final gauge. The obtained plate products were solution heat treated at 475° C. for about 6 hours, followed by water-spray quenching. The resultant plates were stretched by a cold stretching operation for about 2%. The stretched plates have been aged using a two-step ageing practice of first 5 hrs/120° C. followed by 12 hrs/165° C. Mechanical properties have been tested analogue to Example 3 in three test directions and the results are listed in Table 12 and 13. The specimens were taken from S/4 position from the plate for the L- and LT-testing direction and at S/2 for the ST-testing direction The Kapp has been measured at S/2 and S/4 locations in the L-T direction using panels having a width of 160 mm centre cracked panels and having a thickness of 6.3 mm after milling. These Kapp measurements have been carried out at room temperature in accordance with ASTM E561. The designation "ok" for the SCC means that no failure occurred at 180 MPa/45 days.

From the results of Tables 12 and 13 it can be seen that the alloy according to the invention in comparison with AA7050 has similar corrosion performance, the strength (yield strength and tensile strength) are comparable or slightly better than AA7050, in particular in the ST-direction. But more importantly the alloy of the present invention shown significantly better results in elongation (or A50) in the ST-direction. The elongation (or A50), in particular the elongation in ST-direction, is an important engineering parameter of amongst others ribs for use in an aircraft wing structure. The alloy product according to the invention further shows a significant improvement in fracture toughness (both $K_{1C}$ and Kapp).

TABLE 11

Chemical composition of the alloys tested, balance impurities and aluminium.

| Alloy | Si | Fe | Cu | Mn | Mg | Zn | Ti | Zr |
|---|---|---|---|---|---|---|---|---|
| C | 0.02 | 0.04 | 2.14 | — | 2.04 | 6.12 | 0.02 | 0.09 |
| D | 0.03 | 0.05 | 1.58 | 0.07 | 1.96 | 7.35 | 0.03 | 0.09 |

TABLE 12

Tensile test results of the plate products for three testing directions.

| Alloy | TYS (MPa) L | TYS (MPa) LT | TYS (MPa) ST | UTS (MPa) L | UTS (MPa) LT | UTS (MPa) ST | Elong (%) L | Elong (%) LT | Elong. (%) ST |
|---|---|---|---|---|---|---|---|---|---|
| C | 483 | 472 | 440 | 528 | 537 | 513 | 9.0 | 7.3 | 3.3 |
| D | 496 | 486 | 460 | 531 | 542 | 526 | 9.2 | 8.0 | 5.8 |

TABLE 13

Further properties of the plate products tested.

| Alloy | L-T KIC (MPa · $m^{0.5}$) | T-L KIC (MPa · $m^{0.5}$) | S-L KIC (MPa · $m^{0.5}$) | L-T Kapp (MPa · $m^{0.5}$) | | EXCO | SCC |
|---|---|---|---|---|---|---|---|
| C | 27.8 | 26.3 | 26.2 | 45.8 (s/4) | 52 (s/2) | EA | ok |
| D | 30.3 | 29.4 | 29.1 | 62.6 (s/4) | 78.1 (s/2) | EA | ok |

Example 8

On an industrial scale two alloys have been cast via DC-casting with a thickness of 440 mm and processed into a plate product having a thickness of 63.5 mm. The alloy compositions are listed in Table 14, whereby alloy F represents an alloy composition according to a preferred embodiment of the invention when the alloy product is in the form of plate for wings.

The ingots were scalped, homogenized in a two-step cycle of 12 hrs/470° C.+24 hrs/475° C. and air cooled to ambient temperature. The ingot was pre-heated at 8 hrs/410° C. and then hot rolled to final gauge. The obtained plate products were solution heat treated at 475° C. for about 4 hours, followed by water-spray quenching. The resultant plates were stretched by a cold stretching operation for about 2%. The stretched plates have been aged using a two-step ageing practice of first 5 hrs/120° C. followed by 10 hrs/155° C.

TABLE 14

Chemical composition of the alloys tested, balance impurities and aluminium.

| Alloy | Si | Fe | Cu | Mn | Mg | Zn | Ti | Zr |
|---|---|---|---|---|---|---|---|---|
| E | 0.02 | 0.04 | 1.49 | — | 1.81 | 7.4 | 0.03 | 0.08 |
| F | 0.03 | 0.05 | 1.58 | 0.07 | 1.95 | 7.4 | 0.03 | 0.09 |

TABLE 15

Mechanical properties of the products tested for three testing directions.

| | L-direction | | | LT-direction | | | ST-direction | | |
|---|---|---|---|---|---|---|---|---|---|
| Alloy | TYS (MPa) | UTS (MPa) | Elong. (%) | TYS (MPa) | UTS (MPa) | Elong. (%) | TYS (MPa) | UTS (MPa) | Elong. (%) |
| E | 566 | 599 | 12 | 521 | 561 | 11 | 493 | 565 | 5.3 |
| F | 569 | 602 | 13 | 536 | 573 | 9.5 | 520 | 586 | 8.1 |

Mechanical properties have been tested analogue to Example 3 in three test directions are listed in Table 15. The specimens were taken from T/2 position. Both alloys had a EXCO test result of "EB".

From the results of Table 15 it can be seen that the positive addition of Mn results in an increase of the tensile properties. But most importantly the properties, and in particular the elongation (or A50), in the ST-direction are significantly improved. The elongation (or A50) in the ST-direction is an important engineering parameter for structural parts of an aircraft, e.g. wing plate material.

Having now fully described the invention, it will be apparent to one of ordinary skill in the art that many changes and modifications can be made without departing from the spirit or scope of the invention as hereon described.

The invention claimed is:

1. Method of producing a high-strength, high-toughness AA7xxx-series alloy product having a good corrosion resistance, comprising the processing steps of:

a) casting an ingot having a composition comprising, in wt. %:
Zn 6.9 to 7.9
Mg 1.4 to 2.1
Cu 1.43 to 1.90
Zr up to 0.15
Ti<0.05
Fe<0.05
Si<0.07
Mn 0.15 to 0.30,
Cr 0.15 to 0.20
and other impurities or incidental elements each <0.05, total <0.15, and the balance being aluminium;
b) homogenizing the ingot after casting in a range of 460° C. to 490° C., then cooling the homogenized ingot, and then homogenizing the cooled ingot to a temperature in a range of 460° C. to 490° C.;
c) hot working the homogenized ingot by hot rolling to a desired workpiece form, wherein said hot working the homogenized ingot is by said hot rolling with an absence of forging and an absence of extrusion;
d) solution heat treating said formed workpiece at a temperature and time sufficient to place into solid solution essentially all soluble constituents in the alloy;
e) quenching the solution heat treated workpiece by one of spray quenching or immersion quenching in water or other quenching media;
f) stretching of the quenched workpiece at most 8%;
i) artificially ageing the quenched and stretched workpiece in a two step ageing procedure to achieve a temper selected from the group consisting of T74, T76, T751, T7451, T7651, T77 and T79, wherein the artificial ageing comprises a first ageing step at a temperature in a range of 105° C. to 135° C. for 2 to 20 hours and a second ageing step at a temperature in a range of 135° C. to 210° C. for 4 to 20 hours,
wherein the product has a thickness of 2.5 to 11 inches.

2. The method according to claim 1, wherein the alloy has 7.2 to 7.9% Zn, 1.4 to 1.90% Mg, 1.43 to 1.80% Cu, and 0.15-0.20% Cr.

3. The method according to claim 2, wherein the Zr-content in the ingot is 0.06 to 0.15%.

4. The method according to claim 2, wherein the alloy Ti-content is in a range of 0.03-0.05%.

5. The method according to claim 2, wherein the alloy product is artificially aged to a T74 or T76 temper.

6. The method according to claim 5, wherein the alloy has 0.04 to 0.11% Zr.

7. The method according to claim 2, wherein the alloy product is artificially aged to a T7451 or T7651 temper.

8. The method according to claim 2, wherein the Zn-content in the ingot is in a range of 7.2 to 7.7%.

9. The method according to claim 8, wherein the Zn-content in the ingot is in a range of 7.43% to 7.7%.

10. The method of according to claim 2, wherein the Zr-content in the ingot is 0.06 to 0.15%.

11. The method according to claim 2, wherein the alloy has 0.04 to 0.11% Zr.

12. The method according to claim 1, wherein the Zr-content in the ingot is at least 0.06 to 0.13%.

13. The method according to claim 1, wherein the Zr-content in the ingot is in a range of 0.04 to 0.15%.

14. The method according to claim 1, wherein the Zr-content in the ingot is in a range of 0.04 to 0.11%.

15. The method according to claim 1, wherein the product has an EXCO corrosion resistance of "EB" or better.

16. The method according to claim 1, wherein the product has an EXCO corrosion resistance of "EA" or better.

17. The method according to claim 1, wherein the method comprises:
a) the casting of the ingot;
b) the homogenizing of the cast ingot;
c) the hot working of the homogenized ingot by hot rolling to a desired workpiece form;
d) the solution heat treating of said workpiece at temperature in a range of 460° C. to 490° C. for time sufficient to place into solid solution essentially all soluble constituents in the alloy;
e) the quenching of the solution heat treated workpiece by one of spray quenching or immersion quenching in water to a temperature lower than 95° C.;
f) the stretching of the quenched workpiece about 1 to 3%;
g) the artificially ageing of the quenched and stretched workpiece to achieve the temper.

18. The method according to claim 17, wherein the product has the following properties:
exfoliation corrosion resistance ("EXCO") when measured according to ASTM G34-97 is at least "EA" or better;
tensile yield strength of at least 510 MPa,
an ultimate strength of at least 560 MPa, a notch toughness of at least 1.5 and a UPE of at least 200 kJ/m$^2$;
wherein Mg/Zn is 0.27 or lower.

19. The method according to claim 1, wherein the ingot composition comprises, in wt. %:
Zn 7.2 to 7.7
Mg 1.4 to 1.79
Cu 1.43 to 1.80
Zr 0.06 to 0.15
Ti<0.05
Fe<0.05
Si<0.07
Mn 0.15 to 0.30,
Cr 0.15 to 0.20
and other impurities or incidental elements each <0.05, total <0.15, and the balance being aluminium.

20. The method according to claim 19, wherein the method comprises:
a) the casting of the ingot;
b) the homogenizing of the cast ingot;
c) the hot working of the homogenized ingot by a first hot rolling into a pre-worked product;
d) optionally the reheating of the pre-worked product,
e) then hot working the pre-worked product by a second hot rolling to the desired workpiece form;
f) the solution heat treating of said formed workpiece at temperature in a range of 460° C. to 490° C. for time sufficient to place into solid solution essentially all soluble constituents in the alloy;
g) then quenching the solution heat treated workpiece with water;
h) then cold stretching of the quenched workpiece about 1 to 3%;
i) the artificially ageing of the quenched and stretched workpiece in the two step ageing procedure to achieve a desired temper, wherein the artificial ageing comprises a first ageing step at a temperature in a range of 105° C. to 135° C. for 2 to 20 hours and a second ageing step at a temperature in a range of 135° C. to 210° C. for 4 to 20 hours.

21. The method according to claim 20, wherein the product has the following properties:

exfoliation corrosion resistance ("EXCO") when measured according to ASTM G34-97 is at least "EA" or better;

tensile yield strength of at least 472 MPa, an ultimate tensile strength of at least 512 MPa, inter-granular corrosion resistance of at most 70 μm, and wherein Mg/Zn is 0.27 or lower.

22. The method according to claim 19, wherein first hot rolling hot rolls the pre-worked product in a first direction 90° to a second direction in which the second hot rolling hot works the pre-heated ingot.

23. The method of according to claim 19, wherein the Zr-content in the ingot is 0.06 to 0.13%.

24. The method of according to claim 23, wherein the Cu-content in the ingot is 1.52 to 1.80%.

25. The method according to claim 24, wherein the Zn-content in the ingot is 7.43 to 7.7%, the Mg-content in the ingot is 1.4 to 1.79%, the Mn-content in the ingot is 0.19 to 0.3%.

26. The method of according to claim 1, wherein the Cr-content in the ingot is 0.15%.

27. The method of according to claim 1, wherein the Cr-content in the ingot is 0.20%.

28. The method according to claim 1, wherein the ingot composition consists of, in wt. %:

Zn 7.43 to 7.7

Mg 1.4 to 1.79

Cu 1.52 to 1.80

Zr 0.06 to 0.13

Ti 0.03-0.05

Fe<0.05

Si<0.07

Mn 0.19 to 0.30,

Cr 0.15 to 0.20 and other impurities or incidental elements each <0.05, total <0.15, and the balance being aluminium, wherein the method consists of:

a) the casting of the ingot;

b) the homogenizing of the cast ingot in the range of 460° C. to 490° C., then cooling the homogenized ingot, and then homogenizing the cooled ingot to a temperature in a range of 460° C. to 490° C.;

c) the hot working of the homogenized ingot by a first hot rolling into a pre-worked product;

d) optionally the reheating of the pre-worked product, e) then hot working the pre-worked product by a second hot rolling to the desired workpiece form;

f) the solution heat treating of said formed workpiece at temperature in a range of 460° C. to 490° C. for time sufficient to place into solid solution essentially all soluble constituents in the alloy;

g) then quenching the solution heat treated workpiece with water;

h) then cold stretching of the quenched workpiece about 1 to 3%;

i) the artificially ageing of the quenched and stretched workpiece in the two step ageing procedure to achieve a desired temper, wherein the artificial ageing consists of a first ageing step at a temperature in a range of 105° C. to 135° C. for 2 to 20 hours and a second ageing step at a temperature in a range of 135° C. to 210° C. for 4 to 20 hours.

29. The method according to claim 28, wherein first hot rolling hot rolls the pre-worked product in a first direction 90° to a second direction in which the second hot rolling hot works the pre-heated ingot.

30. The method according to claim 29, wherein the product has the following properties:

exfoliation corrosion resistance ("EXCO") when measured according to ASTM G34-97 is at least "EA" or better;

tensile yield strength of at least 472 MPa, an ultimate tensile strength of at least 512 MPa, inter-granular corrosion resistance of at most 70 μm, and wherein Mg/Zn is 0.27 or lower.

31. The method of according to claim 28, wherein the Cr-content in the ingot is 0.15%.

32. The method of according to claim 28, wherein the Cr-content in the ingot is 0.20%.

* * * * *